US006239710B1

(12) United States Patent
Oppelt

(10) Patent No.: US 6,239,710 B1
(45) Date of Patent: May 29, 2001

(54) SMOKE DETECTOR

(75) Inventor: Ulrich Oppelt, Zorneding (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/445,878

(22) PCT Filed: Mar. 24, 1998

(86) PCT No.: PCT/DE98/00857

§ 371 Date: Dec. 14, 1999

§ 102(e) Date: Dec. 14, 1999

(87) PCT Pub. No.: WO99/16033

PCT Pub. Date: Apr. 1, 1999

(30) Foreign Application Priority Data

Sep. 23, 1997 (DE) ..... 197 41 853

(51) Int. Cl.[7] ..... G08B 17/10

(52) U.S. Cl. ..... 340/630; 340/628; 340/577; 340/578

(58) Field of Search ..... 340/628, 630, 340/286.05, 287, 289, 291, 293, 577, 578, 583, 600

(56) References Cited

U.S. PATENT DOCUMENTS

| | | | | |
|---|---|---|---|---|
| 4,181,439 | * | 1/1980 | Tresch et al. | 340/630 |
| 4,647,786 | * | 3/1987 | Guttinger et al. | 250/574 |
| 5,127,729 | * | 7/1992 | Oetliker et al. | 356/317 |

* cited by examiner

*Primary Examiner*—Jeffery Hofsass
*Assistant Examiner*—Daniel Previl
(74) *Attorney, Agent, or Firm*—Michael J. Striker

(57) ABSTRACT

A smoke alarm on the scattered radiation principle. Having a measuring field (5), accessible to smoke particles, in a measuring chamber, at which field the radiation direction of a radiation transmitter (6) is aimed, and scattered radiation occurring in the measuring field (5) can be received by a radiation receiver (7); the measuring chamber includes a portion of the hollow ellipsoid (3) which is mirror-coated on the inside; the measuring field (5) is disposed at the first focal point (1) of the hollow ellipsoid; the radiation receiver (7) is disposed at the second focal point (2) of the hollow ellipsoid (3).

8 Claims, 2 Drawing Sheets

SMOKE DETECTOR

PRIOR ART

The invention is based on the generic type defined by the preamble to independent claim 1.

For detecting fires early, smoke alarms are generally used. One method of detecting smoke particles is to measure radiation scattered at smoke particles. Such smoke alarms based on the scattered radiation principle typically employ the method of forward scattering, because with it larger signals can be attained at the radiation receiver. Such a smoke alarm comprises a radiation transmitter (normally pulsed), a lens for focusing the rays, and a radiation receiver, for instance a photo diode, optionally with a lens for capturing the scattered radiation. Radiation receivers and radiation transmitters have no direct visual communication but instead are optically separated from one another by suitable mechanical provisions. There is an obtuse angle between the direction of radiation transmission and the direction of reception, and the scattering angle at the smoke particles to be detected is also obtuse.

Along with these forward scattering smoke alarms, there are versions with back scattering. In them, radiation transmitters and radiation receivers are disposed side by side, and the scattering angle is acute (German Patent DE 38 31 654 C2). A disadvantage of each of the known methods is that only a small proportion of the scattered radiation strikes the radiation receiver, while the remaining scattered radiation is lost to measurement. Also, only one of the preferred measurement effects is used at a time, that is, either forward scattering or back scattering.

ADVANTAGES OF THE INVENTION

The subject of the invention as defined by the characteristics of claim 1 has the following advantage:

The invention makes it possible to deliver virtually all the radiation scattered at the smoke particles to a radiation receiver in the form of a measurement signal. This signal includes not only the forward scatter and the back scatter but also the scattered radiation from all the ranges in between. This makes the measurement more sensitive overall, since there is almost no loss from uncaptured radiation. The smoke alarm of the invention also takes into account the scattering properties that are due to different particle diameters.

Advantageous refinements are defined by the dependent claims, whose characteristics can also be combined with one another as appropriate.

A light-emitting diode, semi-conductor laser or flash lamp can be provided as the radiation transmitter.

DRAWING

Exemplary embodiments of the invention are shown in the drawing and described in further detail in the ensuing description.

Elements that are substantially identical in different drawing FIGS. are identified by the same reference numerals.

DESCRIPTION OF THE EXEMPLARY EMBODIMENTS

Figure 1:
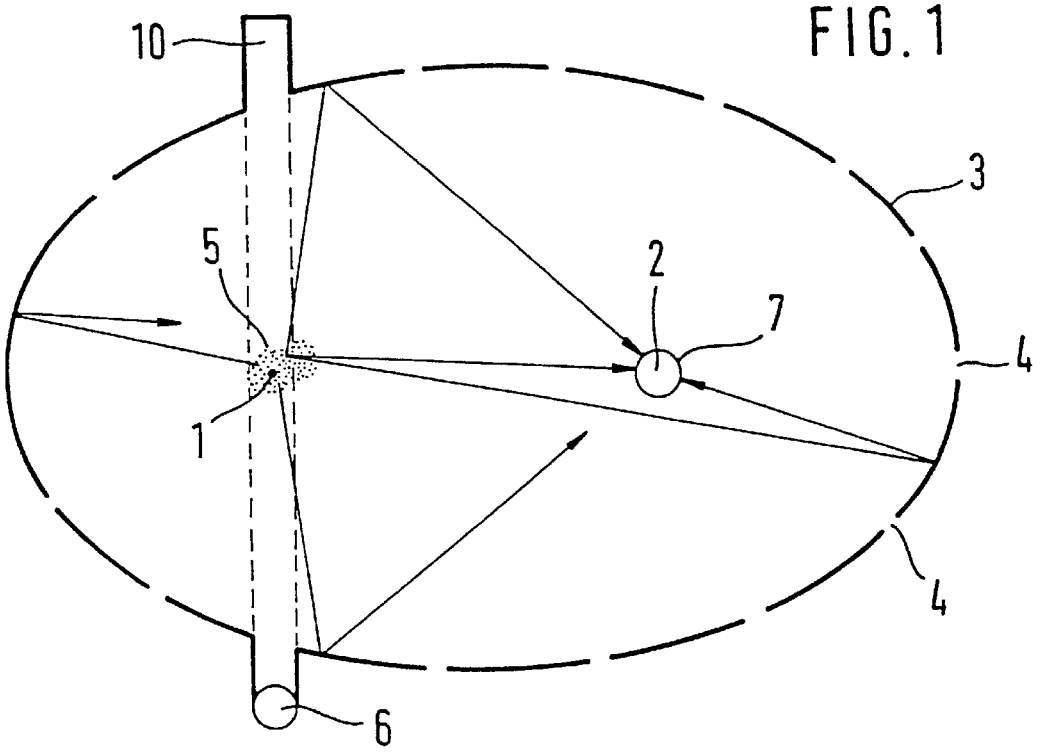
FIGS. 1 through 3 show schematic longitudinal sections through different smoke alarms according to the invention.

FIG. 1 shows the basic arrangement in a section taken through the focal points 1 and 2 of a hollow ellipsoid 3. The hollow ellipsoid 3 is mirror-coated on the inside and is provided with openings 4, which are small in proportion to the inside surface area of the hollow ellipsoid 3, or in other words make up a maximum of 10% of the inside surface area, for example. The first focal point one and its immediate vicinity form the measuring field 5, where smoke particles can be simultaneously irradiated by a radiation transmitter 6 and detected by a radiation receiver 7 at the focal point 2. The radiation receiver 7 includes a radiation collector, which is mounted at the second focal point 2. However, it is also possible instead for the radiation receiver itself to be mounted there. As the radiation collector, it is possible for instance for one hemispherical lens each to be used for the half shell of the hollow ellipsoid 3 located below and above the plane of the drawing, respectively.

Figure 2:
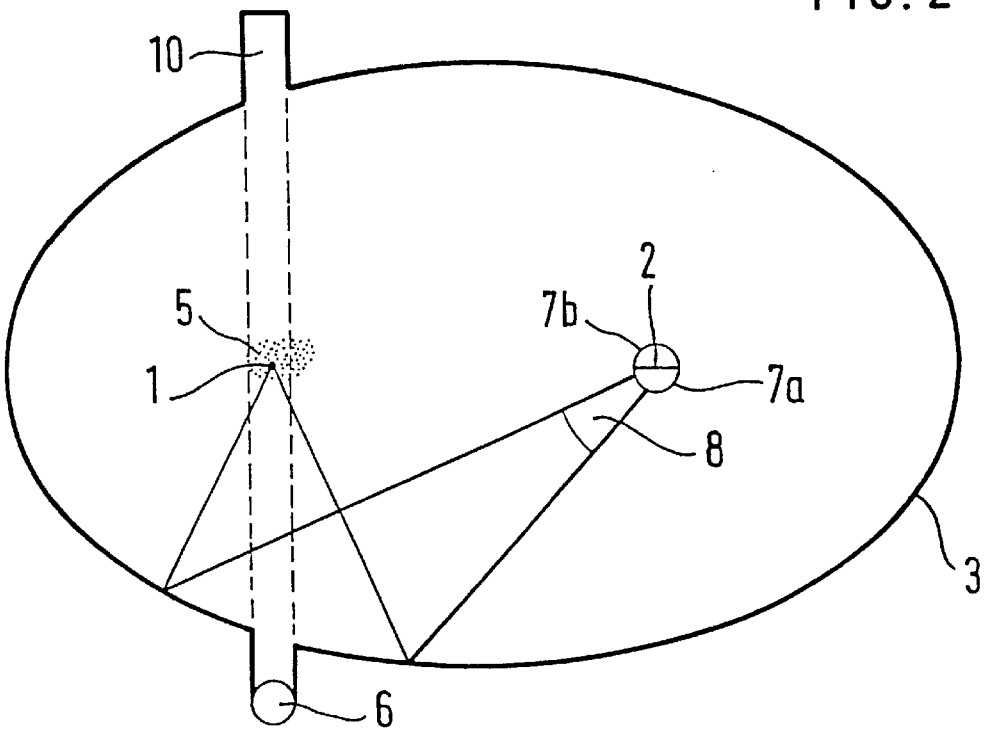

The radiation receiver may comprise one or more photo diodes or some equivalent component. The photo diodes can be disposed such that one preferentially receives the radiation from the back scatter and the other preferentially receives the radiation from the forward scatter, as suggested in FIG. 2, where the region of back scatter is indicated by the reception angle 8. This makes it possible for the scattered radiation, received from the various scatter angles, to be evaluated separately from one another in the same evaluation unit, and to draw conclusions from this about the kind of fire involved that is typical for the particle size found. Other suitable evaluations of angular ranges are also possible.

The mirror formed by the hollow ellipsoid 3 can, as shown in FIG. 1, be provided with a number of openings 4, which make it possible for the smoke particles to penetrate the measuring field 5. The openings 4 are small in terms of surface area occupied compared to the total surface area, so that there is no significant loss in terms of the portion of radiation reflected from the hollow ellipsoid 3.

Figure 3:
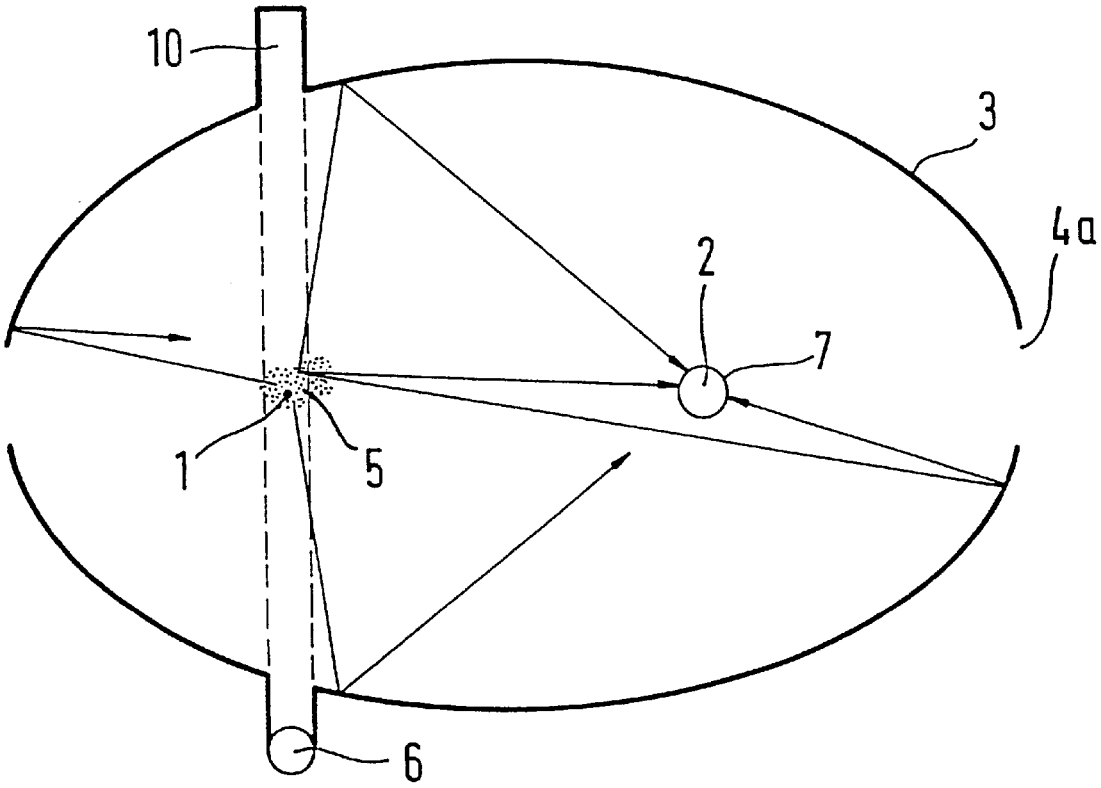

As FIG. 3 shows, it is also possible for one or both summits to be cut open at the ends of the longitudinal axis of the hollow ellipsoid 3, to allow smoke to enter through an opening 4*a*.

Figure 4:
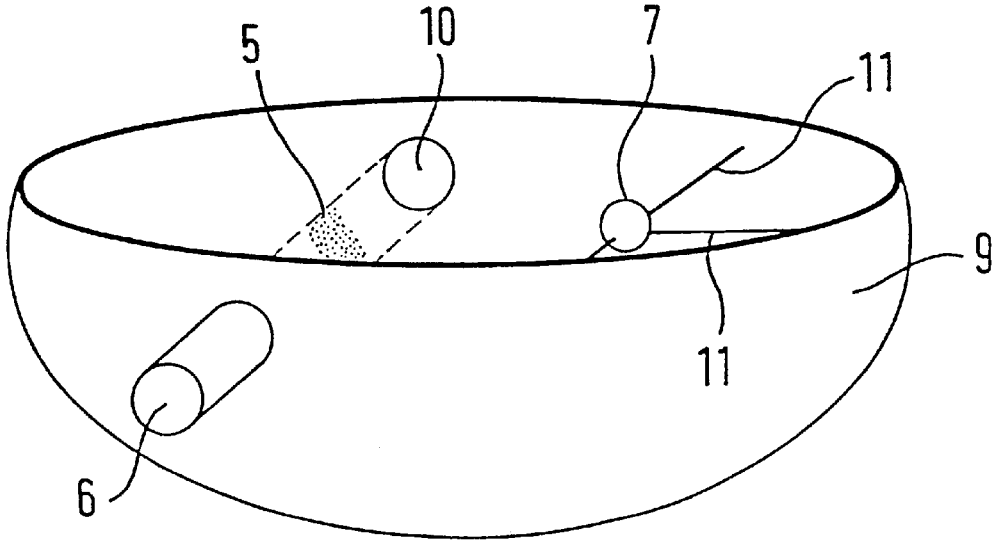
FIG. 4 shows a schematic prospective view of a further exemplary embodiment of the invention.

Finally, as shown in FIG. 4, it is possible to use only one partial shell 9 of a hollow ellipsoid, to allow free access to the smoke particles for measurement. This version is distinguished by a simple structure. It can be seen here that—as in the other drawings as well—a light trap 10 is disposed in the extension of the path from the radiation transmitter 6 to the measuring field 5. Retaining elements 11 for the radiation receiver 7 are shown schematically.

All the exemplary embodiments may, as is usual in optical smoke alarms, be provided with a labyrinth, to prevent extraneous light from entering the hollow ellipsoid 3.

What is claimed is:

1. A smoke alarm on the scattered radiation principle, having a measuring field (5), accessible to smoke particles, in a measuring chamber, at which field the radiation direction of a radiation transmitter (6) is aimed, and scattered radiation occurring in the measuring field (5) can be received by a radiation receiver (7), characterized in that the measuring chamber includes a portion of the hollow ellipsoid (3), which is mirror-coated on the inside;

the measuring field (5) is disposed at the first focal point (1) of the hollow ellipsoid (3);

the radiation receiver (7) is disposed at the second focal point (2) of the hollow ellipsoid (3).

2. The smoke alarm of claim 1, characterized in that the hollow ellipsoid (3) is virtually completely closed and is provided with small openings (4) which however are large enough for smoke to enter.

3. The smoke alarm of claim 1, characterized in that one opening (4*a*) for smoke entry into the measuring chamber is provided at each of the summits around the longitudinal axis of the hollow ellipsoid (3).

4. The smoke alarm of claim 1, characterized in that only a partial shell (9) of the hollow ellipsoid is used as a reflector, and the remaining opening serves to allow smoke to enter the measuring chamber.

5. The smoke alarm of claim 1, characterized in that a first radiation receiver (7*a*) is provided for detecting the back scattering, and a second radiation receiver (7*b*) is provided for detecting the forward scattering.

6. The smoke alarm of claim 1, characterized in that a light-emitting diode is provided as the radiation transmitter (6).

7. The smoke alarm of claim 1, characterized in that a semi-conductor laser is provided as the radiation transmitter (6).

8. The smoke alarm of claim 1, characterized in that a flash lamp is provided as the radiation transmitter (6).

* * * * *